US007938449B2

(12) United States Patent
Pestl

(10) Patent No.: US 7,938,449 B2
(45) Date of Patent: May 10, 2011

(54) EASEL DISPLAY PHOTOGRAPH ALBUM

(75) Inventor: Marcus G. Pestl, Dallas, TX (US)

(73) Assignee: The Antioch Company, LLC, St. Cloud, MN (US)

( * ) Notice: Subject to any disclaimer, the term of this patent is extended or adjusted under 35 U.S.C. 154(b) by 648 days.

(21) Appl. No.: 12/063,282

(22) PCT Filed: Jul. 31, 2006

(86) PCT No.: PCT/US2006/029882

§ 371 (c)(1),
(2), (4) Date: Feb. 8, 2008

(87) PCT Pub. No.: WO2007/021530

PCT Pub. Date: Feb. 22, 2007

(65) Prior Publication Data

US 2009/0140511 A1 Jun. 4, 2009

Related U.S. Application Data

(60) Provisional application No. 60/707,030, filed on Aug. 10, 2005.

(51) Int. Cl.
*B42D 3/00* (2006.01)

(52) U.S. Cl. ..... 281/33

(58) Field of Classification Search ..... 381/31, 381/33; 281/31, 33
See application file for complete search history.

(56) References Cited

U.S. PATENT DOCUMENTS

| | | | | |
|---|---|---|---|---|
| 825,053 | A * | 7/1906 | Hoag | 248/465 |
| 3,199,897 | A * | 8/1965 | Wolfe | 281/33 |
| 4,537,380 | A | 8/1985 | Erickson | |
| D341,374 | S | 11/1993 | Ferranti et al. | |
| 5,316,404 | A | 5/1994 | Hensel | |
| 6,865,837 | B2 * | 3/2005 | Matteau et al. | 40/776 |

OTHER PUBLICATIONS

A PCT Search Report mailed Jun. 13, 2007; 3 pgs.

* cited by examiner

*Primary Examiner* — Dana Ross
*Assistant Examiner* — Matthew G Katcoff
(74) *Attorney, Agent, or Firm* — Dicke, Billig & Czaja, PLLC

(57) ABSTRACT

An album for photographs and similar collectable items comprises a set of one or more straps extending from the album and arranged to either wrap around the edges of the album to hold it closed, or to provide stability to the album when it is opened in an easel configuration for display of the album contents.

16 Claims, 4 Drawing Sheets

EASEL DISPLAY PHOTOGRAPH ALBUM

CROSS-REFERENCE TO RELATED APPLICATION

This application claims priority from U.S. Provisional Application No. 60/707,030 filed Aug. 10, 2005.

TECHNICAL FIELD

This invention concerns albums for photographs and similar collectable items.

BACKGROUND

A type of photograph album comprises a set of permanently attached transparent leaves, each of which has a pocket for one or more photographs. Such albums are often used to carry a set of photographs in a purse or to collect together photographs having a common theme (e.g., selected photographs from a trip or of one's children, and the like). Such albums may suffer from many disadvantages, notably failure to protect their contents, and a cheap appearance.

SUMMARY OF THE INVENTION

In general terms, the invention is an album for photographs and similar collectable items. The album comprises a set of straps, each of which is permanently attached to the back cover of the album at one end, and free at the other. The straps are arranged so that they may either wrap around the edges of the album to hold it closed, or to provide stability to the album so that it may be held open in an unsupported easel configuration for displaying the album contents. The free ends of the straps are clasped to each other and the front cover of the album by a clasping strap or equivalent technique.

BRIEF DESCRIPTION OF THE DRAWINGS

The accompanying drawings schematically illustrate a particular embodiment of the invention as an example, and are not intended to limit the scope of the invention. In particular, the proportions suggested by the figures are preferred but not required except as specifically set forth in the claims.

DETAILED DESCRIPTION

Figure 2:
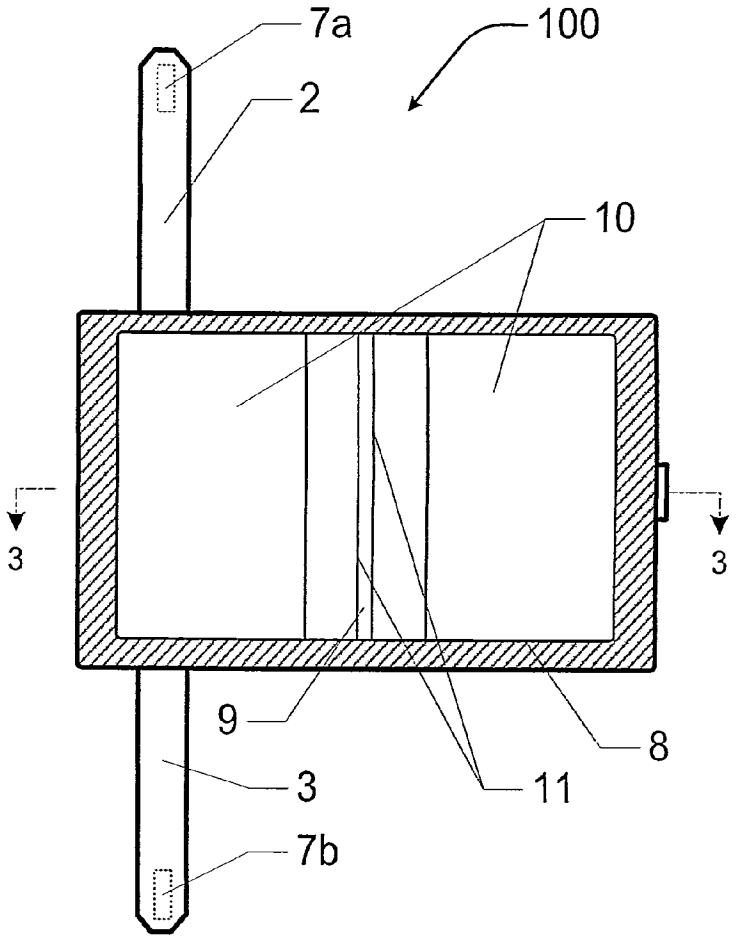
FIG. 2 is a top view of the interior portions of the embodiment of FIG. 1.
Figure 1:
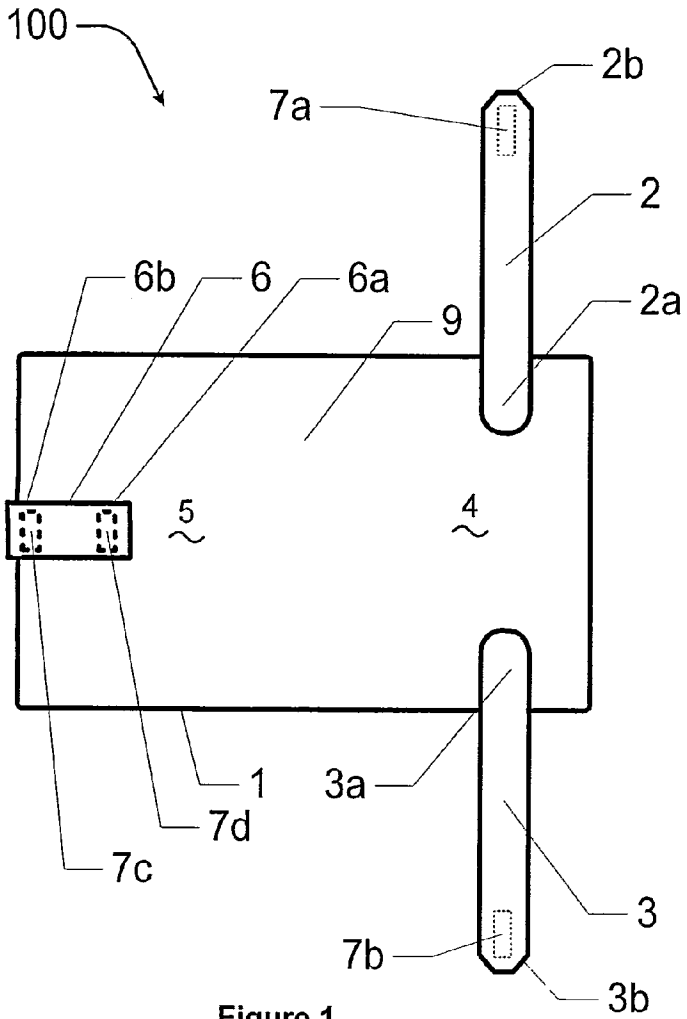
FIG. 1 is a top view of the exterior portions of a preferred embodiment of the invention, opened and laid flat for ease of illustration.

FIGS. 1 and 2 are top views of the exterior and interior, respectively, of a preferred embodiment of album 100. Album 100 comprises a cover 1, which turn may be considered to have two halves lying next to each other in a horizontal direction (i.e., right to left in FIGS. 1 and 2), one of them the back cover 4 and the other the front cover 5. The spine region of cover 1 lies horizontally between and connects back and front covers 4, 5. Extending in the vertical or transverse direction (i.e., up and down in FIGS. 1 and 2) from back cover 4 are two oppositely directed, but otherwise symmetrical, side straps 2 and 3 (although they need not be symmetrical in other embodiments). Each of side straps 2 and 3 is permanently attached to back cover 4 at one of its respective ends 2*a*, 3*a* and not permanently attached to any portion of album 100 on the other, or free, ends 2*b*, 3*b* (respectively). In the preferred embodiment illustrated, ends 2*a*, 3*a* lie atop the outer surface of back cover 4 (and are sewn in place), but this is not required in the most general embodiment of the invention. For example, ends 2*a*, 3*a* could be attached (by sewing or any other equivalent technique) wholly within back cover 4, or could be attached (again, by any technique) to the inner surface of back cover 4.

Clasping strap 6 extends laterally, preferably away from the spine and the front cover 5. Clasping strap 6 is permanently attached to front cover 5 at some location along its length, preferably (but not necessarily) at one end, with the other end free from attachment to front cover 5. (Similarly to straps 2 and 3, clasping strap 6 may be attached above, within, or below front cover 5.) As illustrated, the preferred embodiment is that clasping strap 6 is permanently attached to front cover 5 such that the opposite free end 6*b* extends beyond the edge of front cover 5. However, in a non-preferred embodiment of the invention, clasping strap 6 could be permanently attached to front cover 5 at end 6*b* (whether or not it extended beyond that edge), and the other end, 6*a*, could be the unattached free end. Or, in an embodiment similar to the alternative embodiment described above for strap ends 2*a* and 3*a*, end 6*b* of clasping strap 6 could be attached (by sewing or any other equivalent technique) wholly within front cover 5.

One or more magnets are embedded within any of the side or clasping straps. In the preferred embodiment illustrated, four magnets 7*a-d* are embedded within side straps 2, 3 (one magnet each) and clasping strap 6 (two magnets). They are indicated by dashed lines because it is preferred (although not required) that they are not visible from the outside of the straps. At a minimum, since alternatives to magnets are within the scope of the invention as discussed further below, the dashed lines indicate generally the locations of the magnets or any equivalent feature within the scope of the invention. For each of side straps 2, 3, that location is the non-permanently attached, or "free" end of each strap. For clasping strap 6, one magnet is preferably located in a permanently attached region 6*a*, and the other in the non-permanently attached, or free, region 6*b*. This location is preferred, although it is possible to construct an embodiment of the invention which has a clasping strap that is permanently attached to rear cover 5 at a point between its two free ends, each of which has a magnet 7*c*, 7*d*. Suitable magnets are neodymium iron boron (NdFeB) alloy, grade 35.

Figure 3:
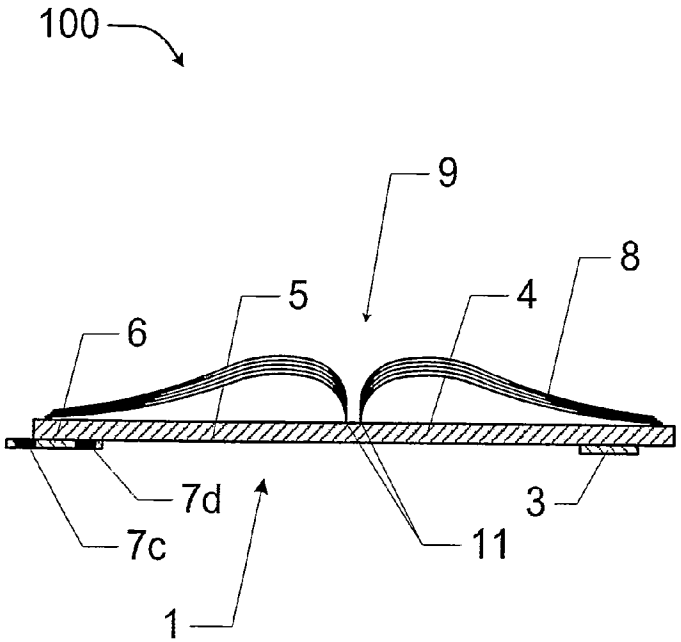
FIG. 3 is a cross-sectional view taken along the line 3-3 of FIG. 2.

Referring specifically to FIG. 2 and also FIG. 3, pocket pages 8 each include two oppositely directed sets of plastic pockets 10, and all of the set of pocket pages 8 are stacked atop each other and together attached to cover 1 in the spine 9 of main section 1. The respective points of connection between pocket pages 8 and spine 9 may need to be spaced apart from each other by a larger than normal amount, so that album 100 may be opened as described in more detail below, or there may be sufficient space and flexibility in the materials chosen for pocket pages 8 so that such spacing is not required. In the preferred embodiment illustrated, there are six pocket pages 8 (and thus twelve pockets 10).

Figure 4:
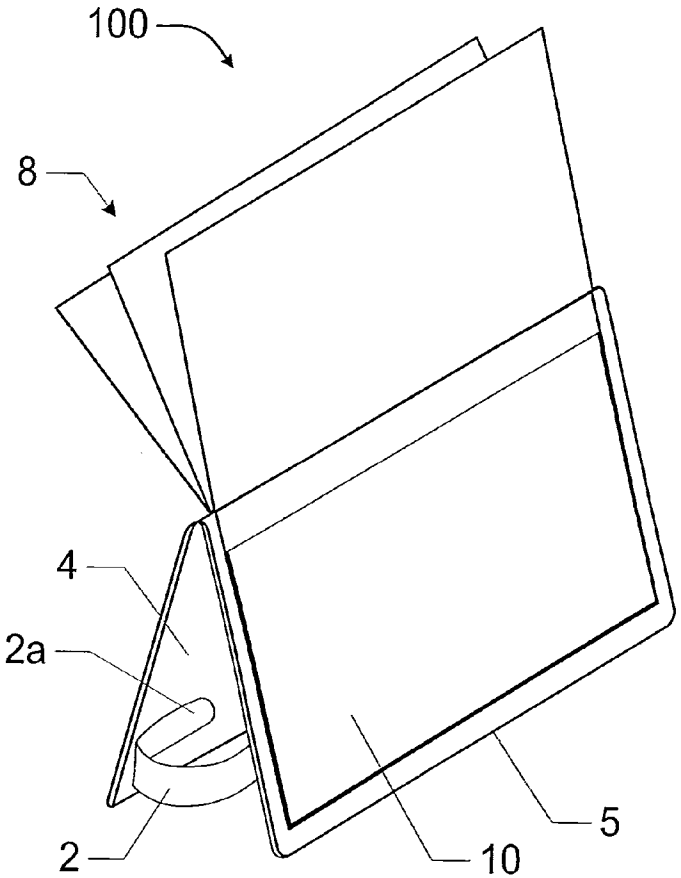
FIGS. 4-7 are perspective views of an embodiment of the invention, taken from various angles.
Figure 5:
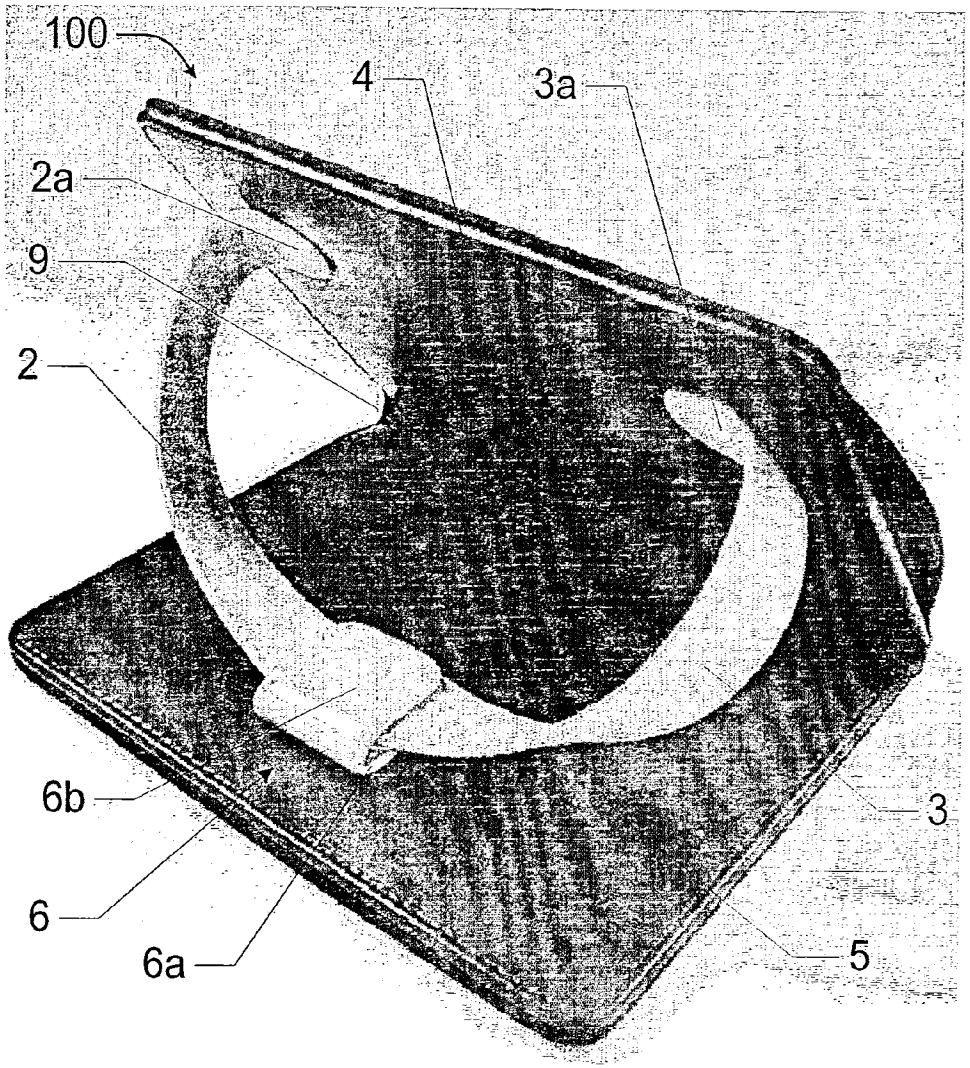

In general, album 100 is constructed using materials and manufacturing techniques known in the art such cover 1 has sufficient flexibility to be fully opened. Thus, back cover 4 may be positioned adjacent to and facing directly toward front cover 5, so that pocket pages 8 are completely exposed to view, as illustrated in FIG. 4. Thus, the flexibility of album 100 permits it to be arranged in an easel configuration. In addition, album 100 may be kept in this easel configuration by extending the free ends of straps 2 and 3 directly from back cover 4 to front cover 5, and then temporarily attaching them to front cover 5 by clasping them with clasping strap 6. This structure, illustrated in FIG. 5, provides sufficient stability for album 100 to stand unsupported on a surface, thus enabling display of the photographs or other items (which are not illustrated, as they are not part of the invention) kept within each pocket 10.

Pocket 10 (which is typical of all such pockets on either side of the album) is preferably a photo-safe material, and/or preferably transparent (although it could be merely translucent). The preferred material is polypropylene, although polyesters are also suitable. Because pocket 10 will ultimately be exposed to the outside of the album when the easel configuration is used, it should be a material that can withstand conditions such as exposure to sunlight (in terms of fading, yellowing, wrinkling, other disadvantages caused by light exposure and/or elevated temperatures, etc.) without losing its ability to both display and protect the underlying photograph or other object.

A single pocket page (two pockets) may be manufactured from three materials: a base sheet (which need not necessarily be transparent), and two cover sheets (which should be transparent as described above). Each cover sheet is attached (e.g., heat sealed, adhered, ultrasonically welded, fused, or another equivalent technique) to the base sheet along three edges, which forms a pocket accessible via the fourth edge of each cover sheet. The fourth edge is left open so that the photograph or other displayed object may be inserted into and removed from pocket 10. The two open edges of each cover sheet face each other and are each adjacent the midpoint of the assembly.

The preferred material for the base sheet is black 0.4 mm thick 70 g spun bonded polypropylene, and the preferred material for each of the cover sheets is clear 0.08 mm thick polypropylene. Other colors of base sheet may be used if desired, and the cover sheets may be matte or glossy or any desired texture or sheen. The preferred means for attaching the cover sheets to the base sheet is heat or sonic sealing in a pattern of evenly spaced 1.5×1.3 mm dots, approximately four dots per centimeter. However, other known equivalent sealing techniques may be employed. Regardless of technique, other sealing patterns (e.g., lines) may be used.

Pocket page 8 is preferably approximately 290 cm in length (the horizontal direction in the figures) and 172 cm in width (the vertical direction in the figures). After allowing for the edge sealing described above, each pocket 10 may be 117.5 cm in length and 167.5 cm in width, which accommodates a conventional 102×152 mm (4×6 inch) photograph having a landscape-oriented image when album 100 is set up in the easel configuration as illustrated in FIG. 4; the additional clearance permits pocket 10 to hold such a photograph even when it is matted on a piece of photo mounting paper, without the fit being too tight for the matted photograph to be removed easily, or the additional clearance leading to the photograph becoming undesirably skewed if it is not matted. Such considerations are preferably included in the selection of dimensions for pocket page 8 because album 100 is designed to display the photograph or other contents of pocket 10 in an attractive manner when the easel configuration is employed.

The distance between each pocket 10 is approximately 50.8 cm, the centermost 3.2 cm of which serves as the location for attachment of the stack of pocket pages 8 to spine 9. The remainder of the unpocketed space enables album 100 to flexibly open despite the front and rear covers being inverted upon themselves, as described above. Of course, these dimensions are not limitations on the scope of the invention, as other embodiments of album 100 adapted for other sizes of photographs, or simply for other sizes of displayed objects, are within the scope of the invention.

The stack of pocket pages 8 is adhered or otherwise permanently attached to spine 9, preferably by sewing to the innermost layer of main portion 1 along two stitch lines 11. Regardless of how the attachment is accomplished, the result must be flexible enough so that, once the entire album 100 is opened to the easel configuration, the contents of each pocket 10 may be displayed by flipping each of pocket pages 8 from front to back until the desired pocket 10 is selected; and, once selected, the desired pocket 10 must remain flat for viewing. (It may be necessary to turn album 100 around so that the selected pocket 10 is visible). In this regard, the use of straps 2, 3, and 4 to provide structure to album 100 so that it may stand unsupported on a surface, is advantageous because it permits album 100 to be used as a display piece for its contents without showing (except from the side) any unsightly mechanism that obscures the view of the contents of album 100.

Figure 7:
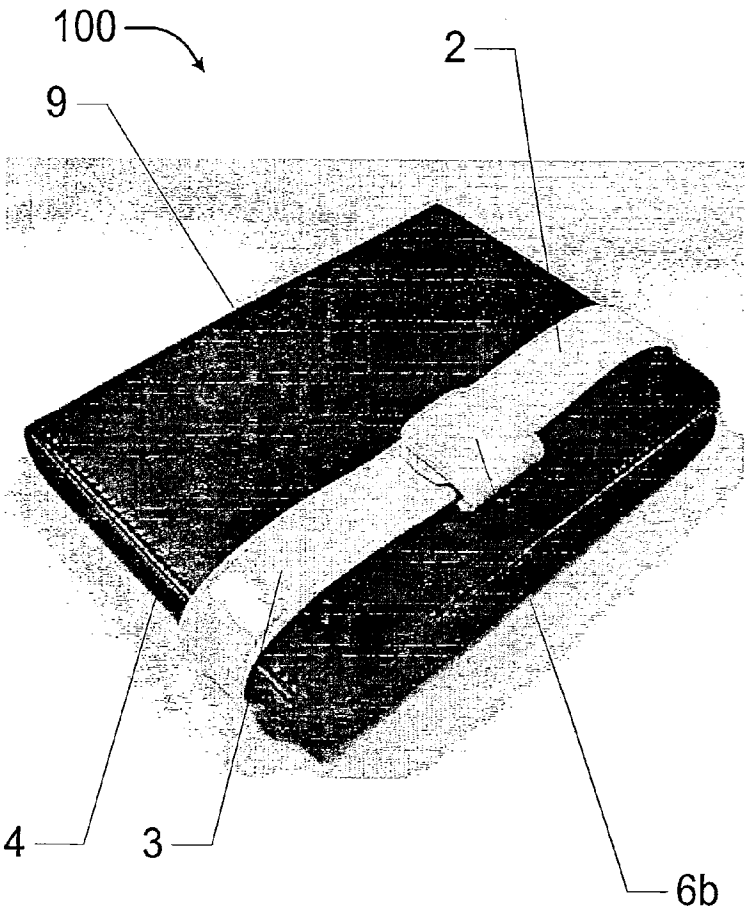
Figure 6:
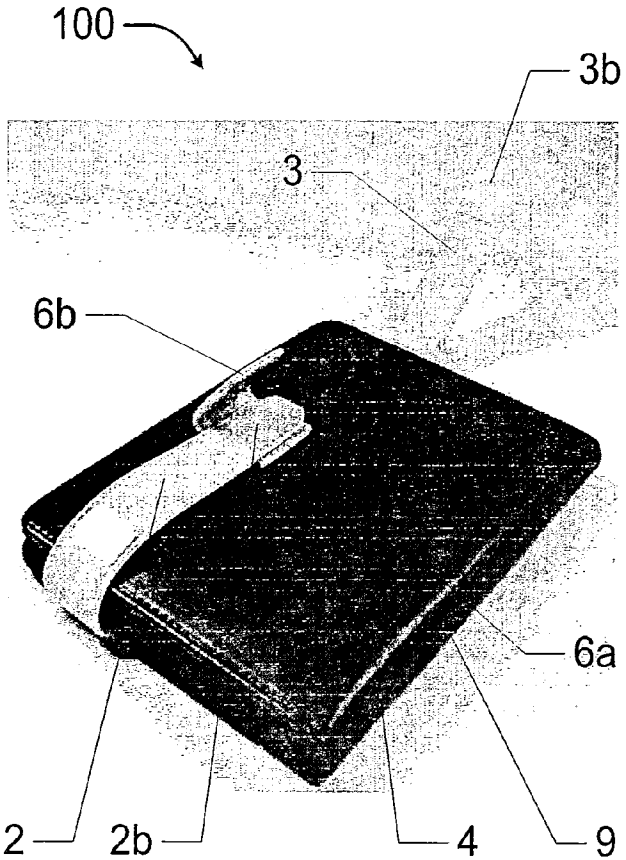

As illustrated in FIGS. 6 and 7, when album 100 is not in the easel configuration (e.g., when it is carried in a purse or otherwise not used to display its contents), it may be securely closed by wrapping the free ends of straps 2 and 3 from the back cover 4 around the side edges of album 100 until they extend to front cover 5, and again attaching them temporarily to each other and/or to front cover 5 with clasping strap 6. In this position, album 100 is in a fully closed position and kept so by the combination of straps 2, 3 and clasping strap 6. Because it is securely closed, the invention provides the advantages of protecting the contents of album 100 from accidentally falling out during transport or storage, such as when album 100 is carried in a purse or other similar container. The appearance of album 100 when closed does not suggest the utilitarian nature of straps 2, 3 and clasping strap 6.

Straps 2, 3 and clasping strap 6, especially if they are a contrasting color from the color of album covers 4 and 5, are elegant and durable in appearance, especially if (as in the preferred embodiment), the outermost surfaces of those pieces are a material such as soft-sided leather, suede, or similar synthetic materials (such as leather-like polyurethanes). Such materials may be supported by a suitable core (e.g., laminates of 2 mm thick foam and 2 mm thick foam board for thickness, and 2 mm thick cardboard for strength). The same leather or leather-like material is preferred for the innermost surfaces of each of straps 2, 3 and 6, while the same or other materials (e.g., canvas for durability) may be used for the innermost surfaces of album covers 4 and 5. When such preferred materials are used, it is especially desired to assemble them into main section 1 by stitching them around the perimeter (e.g., with a size 20/125 needle) in complementary or contrasting color, even if (as is preferred) they are adhered or otherwise internally bound to each other according to principles known in the air. The preferred stitching not only helps prevent delamination, it also adds to the elegance of the appearance of album 100. In general, however, the invention may be embodied in albums that are manufactured from a wide variety of materials, whether flexible or rigid, including metal and other durable materials.

The illustrated embodiment does not employ hardware to secure the ends of straps 2, 3 to each other and/or album 100. Such hardware is prone to being snagged by the interior of a purse or piece of luggage into which album 100 is placed. Another disadvantage of such hardware is that it can be difficult to assemble into the easel and/or closed configurations.

Yet another disadvantage is that such hardware tends to increase the overall thickness of the album by an undesirable amount. However, in less preferred embodiments, such hardware may be used to secure the invention, and thus all such hardware should be considered as equivalent to the preferred magnets 7*a-d* for temporarily attaching or holding the free ends of straps 2, 3 to each other and/or to clasping strap 6. Less preferred embodiments of the invention may employ conventional hook and loop fasteners; repositionable adhesive; combinations of pins or posts and holes in the straps (or vice versa); hardware such as clasps, snaps, latches, ties, button/loop combinations, and the like; or any other equivalent means for removably fastening objects together.

The location and length of each strap is not critical to the scope of the invention (and depends to large degree on the size of the album), provided that the invention operates as described. That said, the straps function more effectively when they are placed toward the outermost edges of the back and front covers because that provides both a more securely closed configuration and a more stable open configuration than otherwise. However, it is not necessary that the straps be at (or partially beyond) such outermost edges, as reflected in the preferred embodiment illustrated in the figures. The cross-sectional shape of the straps is not critical to the scope of the invention, although as noted above, relatively thin straps are preferred to reduce the overall thickness of the invention.

While the overall dimensions of the invention will vary with the size of intended contents (typically photographs) and materials chosen to construct a particular embodiment, the preferred embodiment illustrated for 4×6 inch (102×152 mm) photographs measures approximately 124 mm×165.5 mm when closed (neglecting the straps).

The principles of the invention have been described and illustrated with respect to the preferred embodiment in which two oppositely directed side straps are employed, but the invention includes use of a single elongated side strap to create the easel configuration using the same general principles. Thus, the set of side straps may contain at least one, and not necessarily only two, such straps.

I claim:

1. A photograph album, comprising a back cover and a front cover lying next to each other in a horizontal direction; a spine region lying horizontally between and connecting the back and front covers; a set of oppositely directed side straps, each of which is permanently attached to the back cover at a respective end and not permanently attached to any portion of the album at a respective free end; and a clasping strap permanently attached to the front cover; in which the cover has sufficient flexibility to be fully opened by positioning the back cover adjacent to and facing directly toward the front cover, thus arranging the album in an easel configuration; extending the free end of at least one side strap directly from the back cover to the front cover; and temporarily attaching at least one free end to the front cover to provide sufficient stability for the album to stand unsupported on a surface.

2. The photograph album of claim 1, in which the album is securely closed by wrapping the free end of at least one side strap from the back cover around a side of the album to the front cover, and temporarily attaching the side strap to the front cover.

3. The photograph album of claim 2, in which the set of oppositely directed side straps numbers two side straps temporarily attachable to each other in the vicinity of the front cover.

4. The photograph album of claim 2, in which at least one side strap is temporarily attached to the front cover with the clasping strap.

5. The photograph album of claim 1, in which the clasping strap extends laterally away from the spine and the front cover.

6. The photograph album of claim 1, further comprising at least one magnet embedded within at least one side strap or clasping strap.

7. The photograph album of claim 1, further comprising one of the group consisting of: hook and loop fasteners; repositionable adhesive; and combinations of at least one of pins, posts and holes, clasps, snaps, latches, ties, and button/loop combinations.

8. The photograph album of claim 1, further comprising at least one plastic pocket, attached to the cover in the spine region, the pocket being flexible enough so that, once the entire album is opened to the easel configuration, the contents of the pocket may be displayed by flipping the pocket between the front and back covers.

9. In combination:

a) a photograph album having front and back covers connected by a spine having sufficient flexibility to enable the album to fully open such that the back cover is adjacent to and facing directly toward the front cover in an easel configuration;

b) a clasping strap permanently attached to the front cover; and c) at least one side strap having a free end temporarily directly connectable between the front cover and the back cover to provide sufficient stability for the album to stand unsupported on a surface.

10. In combination:

a) a photograph album having front and back covers connected by a spine having sufficient flexibility to enable the album to fully open such that the back cover is adjacent to and facing directly toward the front cover in an easel configuration;

b) a clasping strap attached to the photograph album which temporarily attaches a side strap permanently attached to the back cover at one end and temporarily attachable by its other end to the front cover by the clasping strap.

11. A photograph album, comprising a back cover and a front cover lying next to each other in a horizontal direction; a spine region lying horizontally between and connecting the back and front covers; a set of two oppositely directed side straps, each of which is permanently attached to the back cover at a respective end and not permanently attached to any portion of the album at respective free ends temporarily attachable to each other in the vicinity of the front cover; in which the cover has sufficient flexibility to be fully opened by positioning the back cover adjacent to and facing directly toward the front cover, thus arranging the album in an easel configuration; extending the free end of at least one side strap directly from the back cover to the front cover; and temporarily attaching at least one free end to the front cover to provide sufficient stability for the album to stand unsupported on a surface; in which the album is securely closed by wrapping the free end of at least one side strap from the back cover around a side edge of the album to the front cover, and temporarily attaching the side straps to the front cover.

12. The photograph album of claim 11, further comprising a clasping strap permanently attached to the front cover.

13. The photograph album of claim 12, in which the clasping strap extends laterally away from the spine and the front cover.

14. The photograph album of claim 12, further comprising at least one magnet embedded within at least one side strap or clasping strap.

15. The photograph album of claim 11, further comprising one of the group consisting of: hook and loop fasteners; repositionable adhesive; and combinations of at least one of pins, posts and holes, clasps, snaps, latches, ties, and button/loop combinations.

16. The photograph album of claim 11, further comprising at least one plastic pocket, attached to the cover in the spine region, the pocket being flexible enough so that, once the entire album is opened to the easel configuration, the contents of the pocket may be displayed by flipping the pocket between the front and back covers.

* * * * *